US009560915B2

(12) United States Patent
Graller et al.

(10) Patent No.: US 9,560,915 B2
(45) Date of Patent: Feb. 7, 2017

(54) 360 DEGREE CHANNEL HINGED CUSHION ASSEMBLY FOR SUSPENSION AND ALLEVIATION OF SITTING DISCOMFORT AND INJURY

(71) Applicants: Amy Graller, Highland Park, IL (US); Catherine Weibel, Winter Park, FL (US); Martha Armes, Tampa, FL (US)

(72) Inventors: Amy Graller, Highland Park, IL (US); Catherine Weibel, Winter Park, FL (US); Martha Armes, Tampa, FL (US)

(73) Assignee: FOUR AGW, LLC, Winter Park, FL (US)

( * ) Notice: Subject to any disclaimer, the term of this patent is extended or adjusted under 35 U.S.C. 154(b) by 129 days.

(21) Appl. No.: 14/734,170

(22) Filed: Jun. 9, 2015

(65) Prior Publication Data

US 2015/0359690 A1 Dec. 17, 2015

Related U.S. Application Data

(60) Provisional application No. 62/013,071, filed on Jun. 17, 2014.

(51) Int. Cl.
*A47C 7/02* (2006.01)
*A61G 7/057* (2006.01)

(52) U.S. Cl.
CPC ..... *A47C 7/021* (2013.01); *A61G 5/1045* (2016.11); *A61G 7/05715* (2013.01)

(58) Field of Classification Search
None
See application file for complete search history.

(56) References Cited

U.S. PATENT DOCUMENTS

| | | | | | |
|---|---|---|---|---|---|
| 679,915 | A | | 8/1901 | Rudolf | |
| 2,156,629 | A | | 5/1939 | Hutchinson | |
| 2,765,480 | A | | 10/1956 | Mueller | |
| 3,680,918 | A | * | 8/1972 | Briggs | A47C 1/16 297/452.41 |
| 4,673,216 | A | * | 6/1987 | Alfer | A47C 7/022 297/423.1 |
| 4,840,425 | A | | 6/1989 | Noble | |
| 4,955,665 | A | * | 9/1990 | Richer | A47C 4/52 160/84.04 |
| 5,035,467 | A | * | 7/1991 | Axelson | A61G 5/1043 297/354.1 |
| 5,046,205 | A | | 9/1991 | Garcia | |
| 5,079,785 | A | | 1/1992 | Garcia | |

(Continued)

FOREIGN PATENT DOCUMENTS

CN 104608848 A * 5/2015

*Primary Examiner* — David E Allred
(74) *Attorney, Agent, or Firm* — Schiff Hardin LLP

(57) ABSTRACT

A cushion assembly has two cushions that are loosely joined by a connector that proceeds through respective diagonal channels in respective corners of the two cushions. The connector has a length that loosely connects the cushions and, by a combination of this length and the diagonal channels, the cushions can be selectively configured co-planar with each other in a V-shape, with any arbitrary angle therebetween, and in a stacked configuration wherein the cushions are atop each other. The connector and the diagonal channels also allow the cushions to be configured at any selected angle between the V-shape configuration and the stacked configuration.

3 Claims, 2 Drawing Sheets

(56) References Cited

U.S. PATENT DOCUMENTS 5,102,195 A * 4/1992 Axelson ..... A61G 5/1043 297/440.2
5,165,130 A * 11/1992 Wendling ..... A47D 13/08 5/424
D343,756 S * 2/1994 Sher ..... 5/655
5,286,089 A 2/1994 Goldman
5,288,132 A 2/1994 Vaughn
5,367,730 A * 11/1994 Sher ..... A47D 13/08 5/632
5,864,904 A 2/1999 Rudick
6,581,227 B1 6/2003 Obermaier
6,783,181 B2 * 8/2004 Scheurer ..... A47C 1/027 297/219.1
6,804,845 B2 10/2004 Stewart, III et al.
7,343,636 B1 3/2008 Castillo
7,344,196 B2 3/2008 Rodriquez
7,757,319 B2 7/2010 Kimball
8,020,931 B2 * 9/2011 Frady ..... A01M 31/02 297/219.1
9,119,477 B1 * 9/2015 LeRoy ..... A47C 20/02
2002/0145321 A1 10/2002 Brightbill et al.
2010/0026077 A1 * 2/2010 Tarumi ..... A47C 7/021 297/452.62
2012/0017375 A1 1/2012 Weibel et al.
2012/0124749 A1 5/2012 Lewman
2013/0092175 A1 * 4/2013 Bhat ..... A61G 7/05776 128/845
2013/0112213 A1 * 5/2013 Bhat ..... A61F 5/00 128/889
2015/0059638 A1 * 3/2015 Bishop ..... B63B 35/79 114/363
2015/0097400 A1 * 4/2015 Heys ..... B60N 2/4492 297/183.1
2015/0101125 A1 * 4/2015 Fang ..... A47D 13/083 5/655
2015/0107025 A1 * 4/2015 Dauphin ..... A47C 7/383 5/638
2015/0265056 A1 * 9/2015 Wang ..... A47C 4/54 297/452.41
2016/0022045 A1 * 1/2016 Lee ..... B60N 2/4876 5/639

* cited by examiner $0° < \Theta < 90°$

360 DEGREE CHANNEL HINGED CUSHION ASSEMBLY FOR SUSPENSION AND ALLEVIATION OF SITTING DISCOMFORT AND INJURY

RELATED APPLICATION

This application claims the benefit of the filing date of provisional application 62/013,071 filed on Jun. 17, 2014, the content of which is incorporated herein by reference.

BACKGROUND OF THE INVENTION

Field of the Invention

The present invention generally concerns patient care cushions that are configured to alleviate sitting discomfort, and in particular, cushions used for the prevention, protection or alleviation either of pain, pressure or discomfort to the pelvic floor, perineum, coccyx and rectal region of the human body caused by sitting.

Description of the Prior Art

Although symptoms of the above type may be centralized in the lower body, secondary sites in the upper body or extremities may be affected, with pain radiating from the original site of pain or discomfort.

Developmentally, humans learn to sit upright at the age of approximately five months. Humans progressively gain motor control and core strength, enabling an upright position to be maintained while sitting on the body's weight bearing surfaces, the ischial tuberosities and greater trochanters.

There is a well-documented need for seat cushions that perform at least one of the following functions. There is a need to pad or protect the user from pain or discomfort caused by either short or long periods of sitting on an un-padded, or insufficiently padded, surface. There is also a need to pad or protect the user from exacerbating pain or discomfort from an existing pathology or injury, such as childbirth, traumatic injury, surgery, etc.

There is furthermore a need to lift the user off of the surface of a seat by redistributing weight and allowing the suspension of affected body parts above the seat.

There is also a need to create an ergonomically correct seated position and posture for the user.

A number of products are known that have attempted to address these needs for protection or alignment correction.

Among these is the well known "donut" foam seat cushion, which is cylindrical with a hollow core for pressure relief, so named because it is in the shape of a donut with a hole in the middle. The donut foam cushion is large and is made of relatively dense material. The donut cushion, as one of few options that are available to users, has not received complete acceptance, due to its cumbersome size, the obviousness of its use (some users would prefer a cushion that is not so noticeable when in use), and issues with comfort. Examples of such cushions are disclosed in U.S. Pat. Nos. 5,079,785 and 5,046,205 and 5,288,132.

While the donut cushion does promote pressure relief due to the hollow core, it may cause a pressure build-up as a result of the user's weight displacement into the center of the circle. The vascular supply to the perineum may be altered secondary to the increase in pressure around the ring from the user's weight being subject to natural gravitational forces, so as to displace the tissue down into the central opening.

A U-shaped cushion with a thermal transfer unit is described in U.S. Pat. No. 7,344,196.

Another commercially available product is the so-called "Tush Cush," described in U.S. Pat. No. 4,840,425 which is a padded seat cushion in the shape of a square, having a small central opening in order to decrease pressure on the coccyx. The cushion itself is not adjustable, and the limited size of the opening may decrease pressure only for users who fall within a relatively limited range of weights and body types. Moreover, this cushion is large and bulky, and does not address pressure relief in the perineum.

SUMMARY OF THE INVENTION

The 360 degree channel hinged cushion assembly according to the invention is distinguished by its ability to use elevation from, and minimal physical contact with, the seating surface to increase circulation to the user's body, and possessing the unique characteristic of a 360 degree channel hinge allowing application by a method that does not require the user to stand, or be lifted, off the seating surface. There is a clear need for a resilient, adjustable, configurable, durable, affordable solution for alleviating pain, discomfort and secondary injury experienced by users of seat cushions.

There are five areas in which the 360 degree cushion excels in its design and physical characteristics: Size/Shape, Materials, Placement, Construction and Application. When combined, these features provide a unique and superior product as compared to existing products, none of which address or excel in all five areas. Whether seeking comfort, post-operative protection, posture control or injury prevention, there is no single solution currently in existence that supports the combination of these goals.

Anatomical Considerations:

Developmentally, humans learn to sit upright at the age of approximately 5 months. We progressively gain motor control and core strength, enabling us to maintain an upright position while sitting on our weight bearing surfaces of the pelvis and lower extremities, specifically the ischial tuberosities, greater trochanters and femurs. On average, a person may spend 8-10 hours per day, in either short or long-term increments. The body experiences wide range of positions and seating surfaces while at rest, working, driving, eating, and in social activities.

The posterior aspect of the pelvis consists of two pelvic bones, the sacrum and coccyx. The pelvic girdle includes the ilium, ischium, pubis, sacrum and coccyx. The femurs are attached on the sides by way of the acetabulum.

This bony mass (pelvis) actually moves and is structured as one piece with movement ability to adjust, compensate or stabilize with various postures. The bony aspect of the pelvis differs between males and females. Measurements are usually taken from front to back (distance from the pubis to the sacrum) and from right to left (transverse median diameter) and the (useful diameter) usually measures at least 12 centimeters with females to allow engagement during childbirth. The measurement from the left to the right ischial tuberosity is usually 11 centimeters in length and the distance from the pubis to the coccyx is typically from 9 to 9.5 centimeters in length. These measurements are typical in a female pelvis, while the male pelvic girdle generally measures smaller. Though based on this measurement data, the 360 degree cushion design does accommodate wider and narrower frames.

Attached to this bony structure is the pelvic floor. The pelvic floor encloses the bottom of the lower pelvis. It is composed of two layers. The superficial layer is referred to as the perineum and the deep layer of thick muscles is the pelvic diaphragm. Along with the pelvic floor we considered the organs in the pelvic region: the bladder, urethra, prostate, vagina and rectum. The function of the pelvic floor is to support pelvic and abdominal organs, stop and start urination, and for sexual appreciation. The pelvis has an intricate vascular and neurological supply to allow for proper function, health and wellness of the pelvic girdle tissue. The pelvis receives the weight of the upper body and passes it on to the lower limbs.

Our focus of the inventive cushion assembly is on the ischial tuberosities and the pelvic floor.

Size and Shape

The measurements of the 2 cushion members accommodate a large majority of users described above The height is low enough to allow a healthy and stable posture, yet high enough to prevent body contact with the seating surface The 360 degree cushion is designed to lift perineal tissues away from a seating surface improving vascularization to the affected tissue. This not only promotes healing, but also prevents secondary injury as seen with the use of donut-shaped products which restrict blood flow to the perineum and produce additional pressure from their closed circular design.

The 360 degree cushion promotes a correct "spine neutral" seated position with symmetrical weight bearing on bilateral ischial tuberosities. Not only does this relieve the discomfort in the under-surface (perineum) but also allows for correct posture and spinal alignment, which are critical for weight to be distributed evenly from one vertebral segment to another. This may ultimately decrease low back, thoracic and cervical pain and discomfort.

Users of the 360 degree cushion will benefit from the portable nature and discreet size of the product when folded with the broad surfaces of the members facing each other, especially when using the 360 degree cushion in public.

Materials

1. Hygienic material is easily cleaned with a disinfectant, eliminating the need for a coating or cover over the 360 degree cushion
2. The surface of the 360 degree cushion prevents sliding out of the desired position on the seating surface
3. The composition and density of the core material were specified to maximize product performance toward our goals of support, stability, elevation, resiliency and user comfort
4. Air or liquid filled chambers are not used, in order to prevent user instability and collateral injury from the user compensating for cushion movement Placement 1. The 360 degree cushion may be adjusted to the anatomical width of the user's pelvis, accommodating both female and male pelvic girdles.
2. It may be positioned with the connector in the front, to relieve pressure on the surrounding fascia and muscle tissue involved in the pelvic floor including the perineum, urethra, prostate, vagina, and rectum.
3. Alternately, it may be positioned with the connector in the back, alleviating pubic, vaginal, prostatic injuries or pain, including post labor-and-delivery.

Construction:

1. The simplicity of the 360 degree cushion design makes it superior in a cost-benefit comparison against products constructed with fabric, vinyl, Velcro®, zippers, snaps, handles or any component requiring sewing (or their labor intensive implementation during manufacturing).
2. The 360 degree cushion consists of two identical members and one connector, greatly reducing manufacturing time, product cost, and ultimately, points of potential failure during use
3. The unique connector may be simple in design, but provides exceptional durability and protection from product damage. The placement of rigid channels within the body of the cushion members prevents product failure under frequent use. They are placed precisely to allow both the lateral and rotational movement of the members, while maintaining the optimal benefit when adjusted to suit the user.
4. The connector is strong, yet flexible, and of the precise length to allow full rotation of one member around the other, while maintaining the correct distance between members during use.

Application

1. Further to its unique physical characteristics, the 360 degree cushion allows the unprecedented ability to be inserted under a user that can remain seated. This method requires only minimal movement on the part of a user, and can be initiated by a third party if the user is immobile.
2. The 360 degree, rotational ability provided by the connector allows for the easy placement of the 360 degree cushion without requiring the user to stand up from the seating surface. The user may lean slightly to one side, placing the opposite member under them in position on the seat. The other member is rotated and passed behind the user's back, and is placed in position by the user leaning slightly in the opposite direction.

DESCRIPTION OF THE PREFERRED EMBODIMENTS

Figure 1:
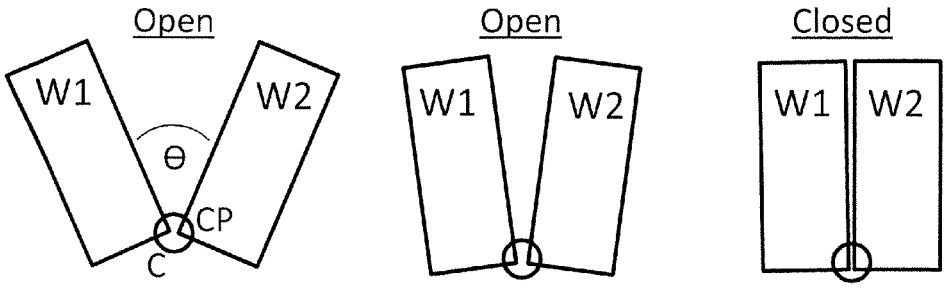
FIG. 1 is a top view of the cushion assembly according to the invention in two open configurations and in a closed configuration.

FIG. 1 shows how the cushion assembly can be selectively configured to provide different angles θ between the wings W1 and W2. The left portion of FIG. 1 shows the wings W1 and W2 in a relatively wide open configuration, whereas the center portion of FIG. 13 shows the wings W1 and W2 in a still open, but more closed configuration, and the right portion of FIG. 1 shows the cushion assembly in a closed position, with the wings W1 and W2 being directly adjacent to each other. The right portion in FIG. 1 may be used, for example, for carrying the V-cushion assembly in a compact form.

Figure 2:
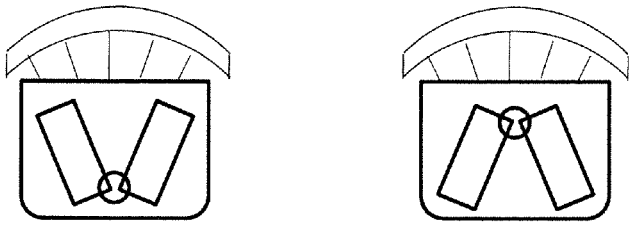
FIG. 2 shows top views of two ways that the cushion assembly can be arranged on a chair seat.

FIG. 2 is a top view showing how the cushion assembly can be placed on the seat of a common chair. The cushion assembly can be placed with a V-shape being open toward the back of the chair, as illustrated in the left portion of FIG. 2, or with the V-shape being open toward the front of the chair, as shown in the right portion of FIG. 2. Depending on the preferences and comfort of the user, either orientation may be appropriate.

Figure 3:
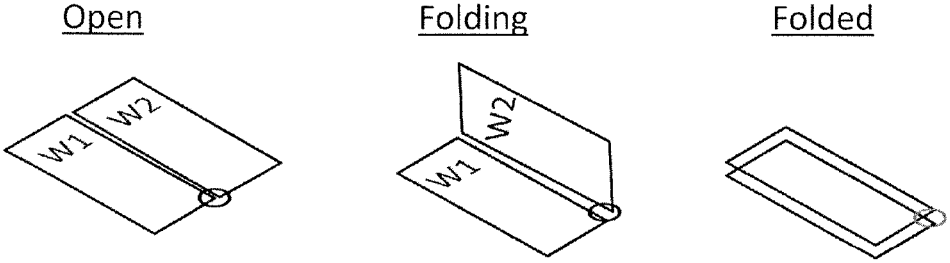
FIG. 3 shows how the channel hinge allows the cushions of the assembly to be folded to a compact arrangement for storing.

FIG. 3 shows how the connector allows further folding of the wings W1 and W2 of the cushion assembly, in addition to the above-described adjustability of the angle of the V-shape. As shown in the left illustration in FIG. 3, the wings W1 and W2 can lie completely flat, when in the closed position described above in connection with the right illustration in FIG. 1. As shown in the center illustration in FIG. 3, the wings W1 and W2 can be folded out of the plane shown in the left illustration, into a completely folded configuration as shown in the right illustration in FIG. 3.

Figure 4:
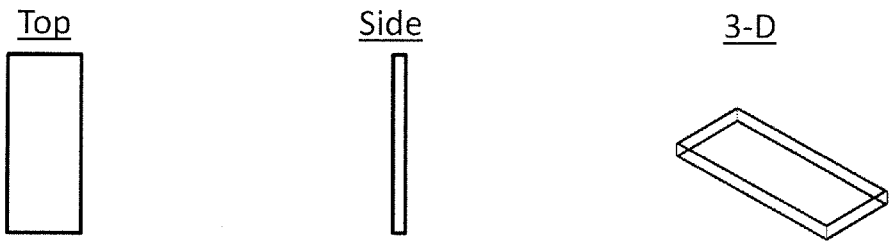
FIG. 4 shows top, side and perspective views of one cushion of the cushion assembly.

FIG. 4 shows top, side and perspective views of one wing member of the cushion assembly. The other wing of the cushion assembly has the same shape. As shown in FIG. 4, each wing is basically a rectangular foam member, which can be covered by any suitable covering.

Figure 5:
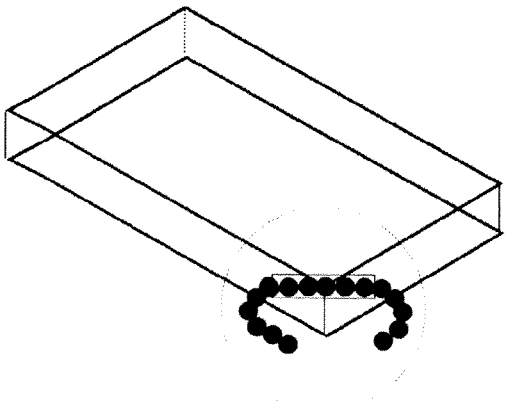
FIG. 5 illustrates the placement of the channel hinge, in an embodiment wherein the channel hinge is formed as a chain.
Figure 6:
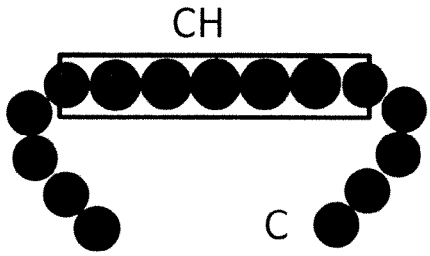
FIG. 6 shows an enlargement of the circled detail of FIG. 5.

The channel connector in the cushion assembly according to the invention is shown for one wing in FIG. 5, and it proceeds mirror-symmetrically from the other wing as well. Each wing has a channel that proceeds diagonally through a corner of the wing. FIG. 6 shows the connector in detail, in the embodiment of a chain. Only a portion of the chain is shown in FIG. 5 and in FIG. 6, but the chain will be continuous, as represented by the circle in FIGS. 1, 2 and 3. The diagonal channel in each wing allows the different configurations shown in FIG. 3 to be achieved, so that the cushion assembly can be configured between any of the use configurations shown in FIGS. 1 and 2, and can be folded as shown in the right view of FIG. 3, for compact storage of the assembly.

Figure 7:
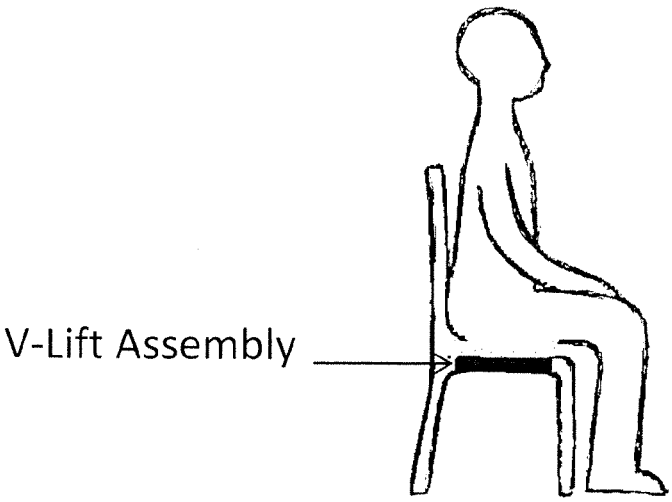
FIG. 7 is a side view of the cushion assembly in use.

FIG. 7 is a side view illustrating the use of the cushion, designated as a V-lift assembly, by a person seated on a chair.

Although modifications and changes may be suggested by those skilled in the art, it is the intention of the inventors to embody within the patent warranted hereon all changes and modifications as reasonably and properly come within the scope of their contribution to the art.

We claim as our invention:

1. A cushion assembly for human seating, comprising:

a first cushion being generally flat in a first plane and having a first cushion corner with a first cushion channel proceeding lengthwise through said first cushion diagonally in said first plane across said first cushion corner;

a second cushion having being generally flat in a first plane and a second cushion corner with a second cushion channel proceeding lengthwise through said second cushion diagonally in said first plane across said second cushion corner; and a connector proceeding through each of said first and second diagonal channels and thereby loosely joining said first and second cushions respectively at said first and second cushion corners, said connector being a continuous flexible ring having a circumference of a length that, in combination with said first and second channels proceeding diagonally across said first and second cushion corners, allows said first and second cushions to be selectively configured into a V-shape wherein said first and second cushions are co-planar and have any selected angle therebetween, and to also be selectively configured with said first and second cushions atop each other in a stack, and to also allow said first and second cushions to be selectively configured between said V-shape configuration and said stack configuration with any angle between said first and second cushions.

2. A cushion assembly as claimed in claim 1 wherein said connector is a chain.

3. A cushion assembly as claimed in claim 1 wherein each of said first and second cushions is a rectangular pad.

* * * * *